US006971766B2

(12) United States Patent
Cull et al.

(10) Patent No.: US 6,971,766 B2
(45) Date of Patent: Dec. 6, 2005

(54) REDUNDANT APERTURE LAMP SYSTEM

(75) Inventors: Brian D. Cull, Glendale, AZ (US); Elias S. Haim, Glendale, AZ (US); Allan E. Harris, Phoenix, AZ (US); John F. Schmidt, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 67 days.

(21) Appl. No.: 10/698,773

(22) Filed: Oct. 31, 2003

(65) Prior Publication Data

US 2005/0094399 A1 May 5, 2005

(51) Int. Cl.[7] ..... F21V 13/00

(52) U.S. Cl. ..... 362/243; 362/248; 362/255; 362/260; 313/448; 313/449

(58) Field of Search ..... 362/20, 227, 237, 362/240–243, 255–256, 561, 248, 260; 313/488, 313/448–449

(56) References Cited

U.S. PATENT DOCUMENTS 2,482,421 A * 9/1949 Lemmers ..... 220/2.1 R
5,143,433 A * 9/1992 Farrell ..... 362/29
5,434,762 A * 7/1995 Shemitz ..... 362/225
5,645,337 A * 7/1997 Gleckman ..... 362/29
5,889,366 A * 3/1999 Yokokawa et al. ..... 313/607
5,903,091 A * 5/1999 MacLennan et al. ..... 313/161
6,186,649 B1 * 2/2001 Zou et al. ..... 362/347
6,218,776 B1 * 4/2001 Cull et al. ..... 313/493
6,224,237 B1 * 5/2001 Wilson ..... 362/223
6,299,328 B1 10/2001 Wilson
6,509,675 B2 * 1/2003 MacLennan et al. ..... 313/113
6,717,348 B2 * 4/2004 Takahashi ..... 313/483

* cited by examiner

*Primary Examiner*—Stephen Husar
*Assistant Examiner*—Jason Han

(57) ABSTRACT

An aperture lamp system that facilitates improved reliability and performance in a display system is provided. The aperture lamp system provides improved reliability by providing a second lamp coupled to a first lamp through a coupling aperture. When the first lamp fails, the second lamp can be used to provide illumination to the display. Specifically, light from the second lamp passes through the coupling aperture to the first lamp, where it can exit the first lamp and illuminate the display. Thus, by coupling the first and second lamps together through a coupling aperture, a lamp system is provided where either the first lamp or second lamp can be used to provide illumination for the display. Thus, the first and second lamps provide redundancy, with this redundancy used to improve the reliability of the display system.

20 Claims, 4 Drawing Sheets

REDUNDANT APERTURE LAMP SYSTEM

FIELD OF THE INVENTION

This invention generally relates to displays, and more specifically applies to improved reliability in displays.

BACKGROUND OF THE INVENTION

Various types of optical displays are commonly used in a wide variety of applications. In many applications, the reliability of the display is of critical importance. For example, in vehicles such as aircraft, optical displays can be used to provide important performance and safety information to the operator. In these applications, the critical nature of the information provided to operator demands high performance and reliability from the optical display.

Unfortunately, many optical display systems have limited reliability. In these displays, the failure of one critical part can render the entire display inoperable. For many applications, this can lead to unacceptably high failure rates. For example, electronic displays are commonly used in aircraft to provide a wide range of critical information to the crew. In such aircraft applications, the reliability of the display is of utmost importance, and even very low failure rates can be unacceptable.

One area where optical displays can exhibit failure is in the lamp illuminating the display. Display lamps can fail in many ways. As one example failure mode, typical fluorescent lamps can fail when one of the cathodes providing electrical charge to the lamp breaks down. When the cathode begins to fail, the performance of the lamp can quickly degrade and in many cases is rendered totally inoperable. In many applications, even a partial degradation of lamp performance can unacceptably degrade the performance of the display. Furthermore, in most cases a complete failure in the lamp illuminating the display will render the display totally inoperable. Again, in applications such as aircraft displays, such failures can be unacceptable even at very low failure rates.

Thus, what is needed is an improved lamp system that provides the improved performance and reliability needed for critical applications.

BRIEF SUMMARY OF THE INVENTION

The present invention provides an aperture lamp system that facilitates improved reliability and performance in a display system. The aperture lamp system provides improved reliability by providing a second lamp coupled to a first lamp though a coupling aperture. When the first lamp fails, the second lamp can be used to provide illumination to the display. Specifically, light from the second lamp passes through the coupling aperture to the first lamp, where it can exit the first lamp and illuminate the display. Thus, by coupling the first and second lamps together through a coupling aperture, a lamp system is provided where either the first lamp or second lamp can be used to provide illumination for the display. Thus, the first and second lamps provide redundancy, with this redundancy used to improve the reliability of the display system.

The foregoing and other objects, features and advantages of the invention will be apparent from the following more particular description of a preferred embodiment of the invention, as illustrated in the accompanying drawings.

BRIEF DESCRIPTION OF DRAWINGS

The preferred exemplary embodiment of the present invention will hereinafter be described in conjunction with the appended drawings, where like designations denote like elements, and.

DETAILED DESCRIPTION OF THE INVENTION

Figure 1:
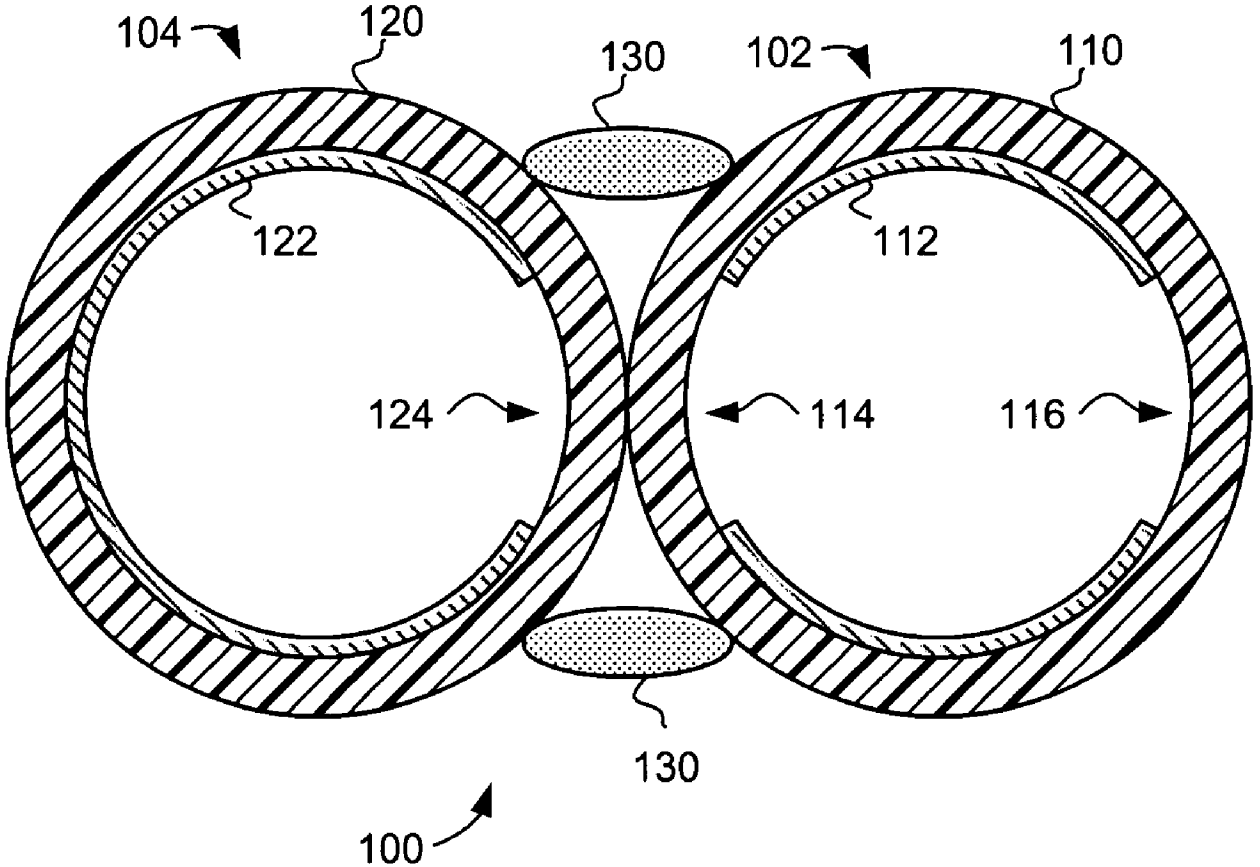
FIG. 1 is a cross-sectional view of an aperture lamp system.

The present invention provides an aperture lamp system that facilitates improved reliability and performance in a display system. The aperture lamp system provides improved reliability by providing a second lamp coupled to a first lamp though a coupling aperture. When the first lamp fails, the second lamp can be used to provide illumination to the display. Specifically, light from the second lamp passes through the coupling aperture to the first lamp, where it can exit the first lamp and illuminate the display. Thus, by coupling the first and second lamps together through a coupling aperture, a lamp system is provided where either the first lamp or second lamp can be used to provide illumination for the display. Thus, the first and second lamps provide redundancy, with this redundancy used to improve the reliability of the display system.

In general, aperture lamps are a type of fluorescent lamp having an internal slit aperture in order to concentrate and direct the emitted light into a narrow angular range. As one example, an aperture lamp can be formed using the same basic structure as a typical tubular fluorescent lamp. In typical tubular fluorescent lamps the lamp comprises a hollow glass tube having a phosphor coating on the entire inside. To form an aperture lamp, the phosphor coating is omitted in one narrow region that forms the "aperture" of the aperture lamp. As with typical lamps, the center of the tube is filled with a mixture of gases which, when exited by an electric current supplied by electrodes (not shown) at the ends of the tube, emits ultraviolet light. The ultraviolet light, in turn, strikes the phosphor coating and is converted to visible light. Because typical phosphor coatings act as a diffuse reflector, the majority of incident light is scattered back into the lamp, while most of the light not reflected is transmitted through the phosphor coating. The aperture in the phosphor coating creates an exit point for the light, and thus the aperture causes the light to be directed preferentially out the aperture. This preferential direction of light is desirable for many different applications, including photocopiers, scanners and in various display systems such as LCD systems.

One limitation in this type of aperture lamp is due to relatively low reflectively and high absorption of the phosphor coating. Typically, the phosphor coating is relatively thin, resulting in poor reflectivity (e.g., between 60 and 80%). This can result in a significant portion of light escaping the lamp in areas other than the aperture. This unwanted transmission of light through the coating can significantly reduce the effectiveness of the aperture lamp.

To improve the effectiveness of the aperture lamp, some implementations add an additional reflective coating inside the lamp. In these embodiments, the reflective coating is typically added to the inside of the glass tube in all areas except in the narrow region where the phosphor is omitted to form the aperture. The addition of the reflective coating improves the effectiveness of this lamp by increasing the amount of light that exits the lamp through the aperture, and decreasing the amount of light that exits the lamp at other areas. This improvement generally comes at a cost of increased manufacturing difficulty and the resulting cost.

Turning now to FIG. 1, a cross-sectional view of an exemplary aperture lamp system 100 is illustrated. The aperture lamp system 100 includes a first lamp 102 and a second lamp 104. The first lamp 102 includes a hollow glass tube 110 having a phosphor coating 112 on the entire inside surface except in a first narrow region that forms an exit aperture 116 and a second narrow region that forms a first coupling aperture 114. Likewise, the second lamp 104 includes a hollow glass tube 120 having a phosphor coating 122 on the entire inside surface except in a narrow region that forms a second coupling aperture 124. The first lamp 102 and second lamp 104 are bonded together with a bonding agent 130, with the bonding agent preferably being reflective to improve light transmission between the second lamp 104 and the first lamp 102. As such, the bonding agent can comprise any suitable material, including silicone rubber, epoxies, RTVs, or combinations thereof.

Individually, the first lamp 102 and the second lamp 104 operate as typical fluorescent lamps. Specifically, the hollow glass tube of each lamp is filled with a mixture of gases which, when exited by an electric current supplied by cathodes that include electrodes (not shown) at the ends of the tube, emits ultraviolet light. The ultraviolet light, in turn, strikes the phosphor coating and is converted to visible light.

The aperture lamp system 100 facilitates improved reliability by providing the second lamp 104 proximate the first lamp 102 and coupled to the first lamp 102 though coupling apertures 114 and 124. If and when the first lamp 102 fails, the second lamp 104 can be used to provide illumination. Specifically, light from the second lamp 104 passes through the coupling apertures 114 and 124 to the first lamp 102, where it can exit the first lamp 102 through the exit aperture 116 and illuminate the display. Thus, by coupling the first lamp 102 and second lamp 104 together through coupling apertures 114 and 116, a lamp system is provided where either the first lamp 102 or second lamp 104 can be used to provide illumination for the display. Thus, the first lamp 102 and second lamp 104 provides redundancy, with this redundancy used to improve the reliability of the display system.

Figure 2:
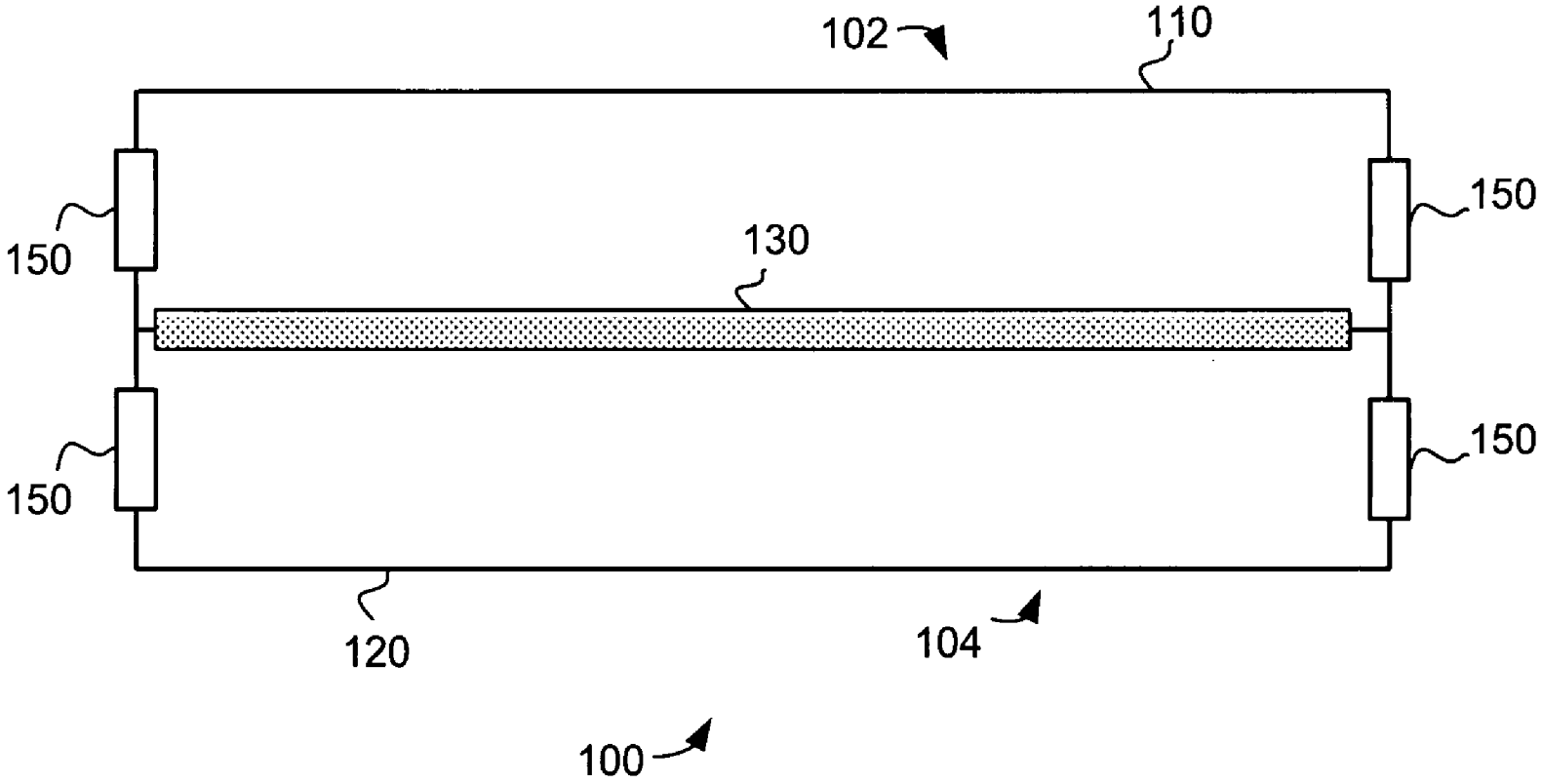
FIG. 2 is a top-view of the aperture lamp system.

Turning now to FIG. 2, a top view of the lamp system 100 is illustrated. FIG. 2 illustrates both lamp 102 and 104 in the lamp system 100 include a pair of cathodes 150. As as failure in a cathode is a common failure mechanism, providing redundant cathodes as part of the lamp system 100 is desirable in most applications. It should be noted that while FIG. 2 illustrates the lamps as comprising simple straight lamps, that the present invention can also be implemented in lamps with a variety of different shapes, include complex serpentine shapes designed to tightly fill a defined area with lamp.

As stated above, some lamp systems add reflective coatings inside the lamp surface to improve the effectiveness of the lamp. In these embodiments, the reflective coating is typically added to the inside of the glass tube in all areas except in the narrow region where the phosphor is omitted to form the aperture. The addition of the reflective coating improves the effectiveness of this lamp by increasing the amount of light that exits the lamp through the aperture, and decreasing the amount of light that exits the lamp at other areas.

Figure 3:
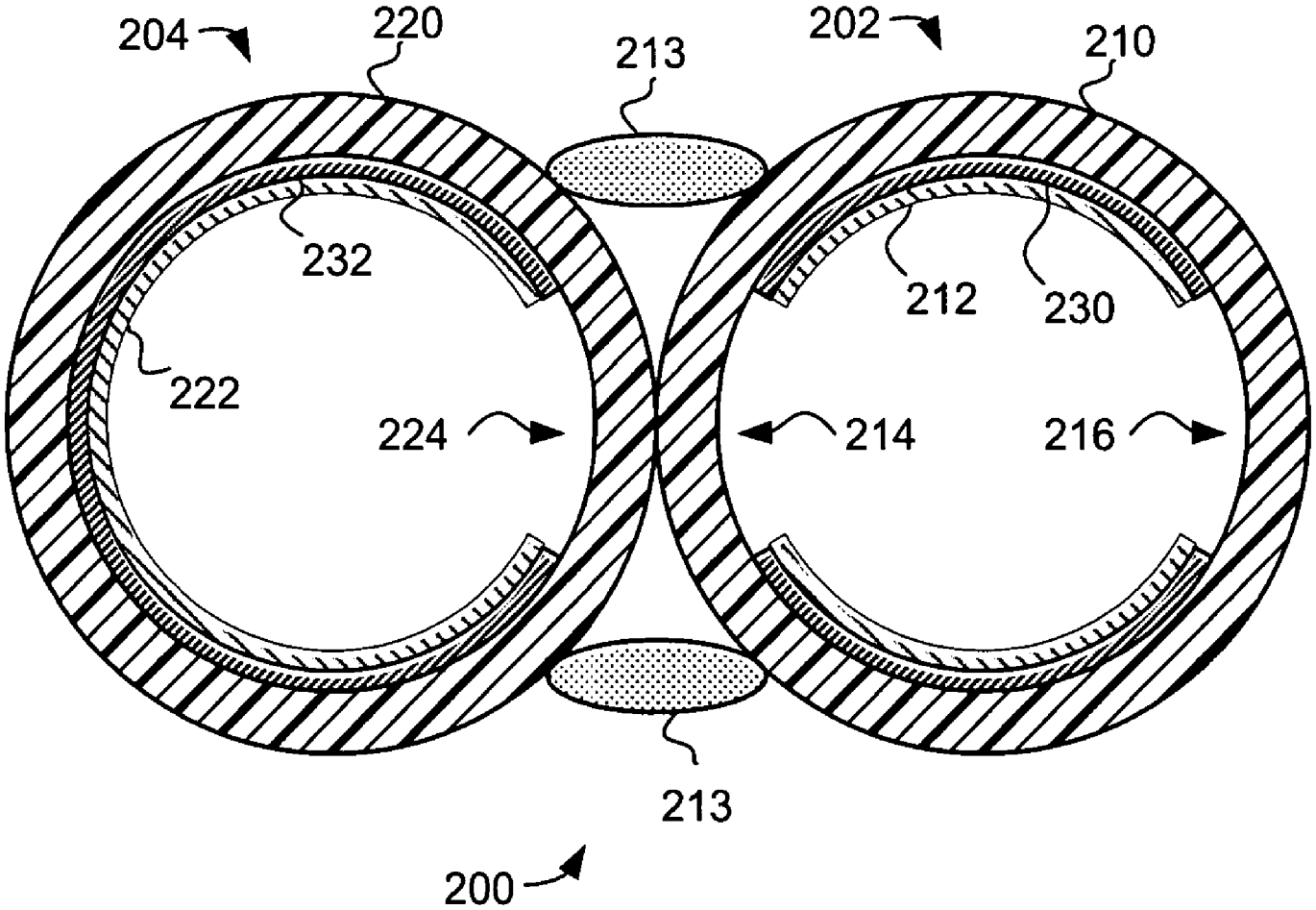
FIG. 3 is a cross-sectional view a second embodiment aperture lamp system.

Turning now to FIG. 3, a cross-sectional view of an exemplary aperture lamp system 200 is illustrated. The aperture lamp system 200 includes a first lamp 202 and a second lamp 204. The first lamp 202 includes a hollow glass tube 210 having a phosphor coating 212 on the entire inside surface except in a first narrow region that forms an exit aperture 216 and a second narrow region that forms a first coupling aperture 214. Likewise, the second lamp 204 includes a hollow glass tube 220 having a phosphor coating 222 on the entire inside surface except in a narrow region that forms a second coupling aperture 224. The first lamp 202 and second lamp 204 are bonded together with a bonding agent 230, with the bonding agent preferably being reflective to improve light transmission between the second lamp 204 and the first lamp 202.

Also added to this embodiment is a reflective coating 230 and 232. Specifically, the reflective coating 230 is added between the hollow glass tube 210 and the phosphor coating 212 in the first lamp 202. This reflective coating 230 is formed covers the interior of the glass tube 210 except in the first narrow region that forms exit aperture 216 and the narrow region that forms the first coupling aperture 214. Likewise, the reflective coating 232 is added between the hollow glass tube 212 and the phosphor coating 222 in the second lamp 204. This reflective coating 232 is formed covers the interior of the glass tube 220 except in the narrow region that forms the second coupling aperture 224.

The addition of the reflective coatings 230 and 232 improves the effectiveness of the lamp system 200 lamp by increasing the amount of light that exits the lamp through the exit aperture 216, and decreasing the amount of light that exits the lamp at other areas. Furthermore, the reflective coating 232 specifically increases the amount of light that passes through the coupling apertures 214 and 224, thus increasing the percentage of light that passes from the second lamp 204 to the first lamp 202, and out the exit aperture 216.

Like the first embodiment, the aperture lamp system 200 facilitates improved reliability by providing the second lamp 204 proximate the first lamp 202 and coupled to the first lamp 202 though coupling apertures 214 and 224. If and when the first lamp 202 fails, the second lamp 204 can be used to provide illumination. Specifically, light from the second lamp 204 passes through the coupling apertures 214 and 224 to the first lamp 202, where it can exit the first lamp 202 through the exit aperture 216 and illuminate the display. Thus, the first lamp 202 and second lamp 204 provides redundancy, with this redundancy used to improve the reliability of the display system.

It should also be noted that in some cases it may be desirable to add the reflective coating to one lamp and not the other. For example, it may be desirable to add the reflective coating to the backup lamp to improve transmission of light to the first lamp, but it may not be as necessary or cost effective to add the reflective layer to the first lamp. Of course, in other embodiments the situation may be reversed.

In other embodiments, it may be desirable to combine tubular fluorescent lamps with flat lamps to create a redundant aperture lamp system. In general, flat lamps are fluorescent lamps constructed from a substrate in which channels are formed. A transparent cover is bonded to the substrate, sealing the channels to form the enclosures that make up lamps in the flat lamp system. In typical implementations, an emissive material that fluoresces in the visible spectrum (e.g., phosphorus) is coated on at least a portion of the channels. The channels are then flushed are filled with a low-pressure gas such as argon, and an electron source material such as mercury. Cathodes are formed at each end of the channel to facilitate electrical connection to the lamp. During lamp operation, the emissive material emits electrons via thermionic emission caused by the electric potential between the two cathodes, causing the emissive material to fluoresce and provide light. More information about flat lamps can be found at U.S. Pat. No. 6,218,776 issued to Brian D. Cull et al and assigned to Honeywell International Inc.

Flat lamps are increasingly being used as light sources in a variety of displays in place of more conventional tubular lamps. For example, flat lamps are used to provide illuminations for liquid crystal displays in a manner similar to tubular fluorescent lamps. The flat lamps are thus a low profile means to generate white light to illuminate the information displayed on the LCD.

Figure 4:
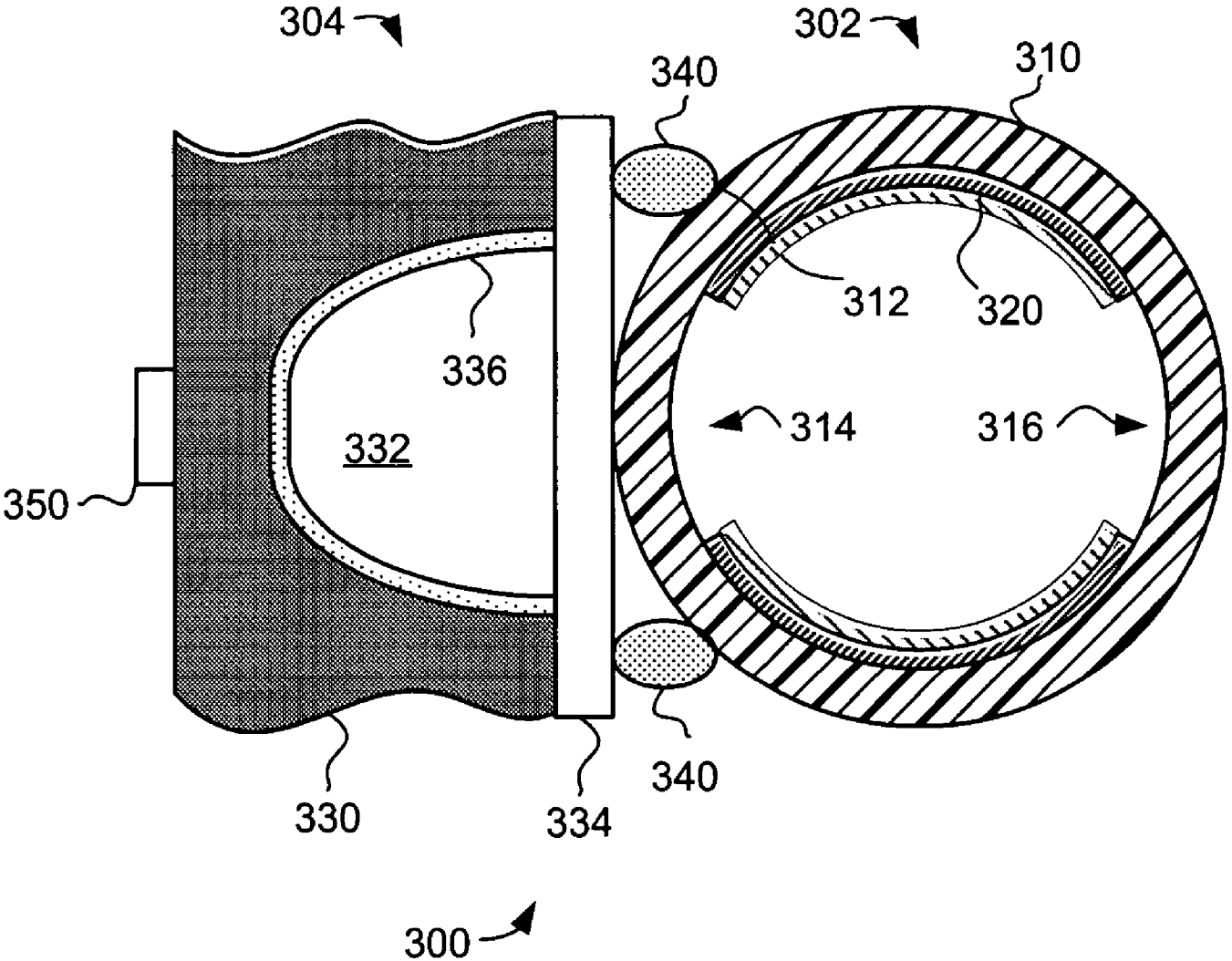
FIG. 4 is a cross-sectional view of a third embodiment aperture lamp system.

In these embodiments a flat lamp is used as the first or second lamp in the aperture lamp system. Again, the second lamp provides redundancy in case of a failure in the first lamp. Turning now to FIG. 4, a cross sectional view of a third embodiment lamp system 300 is illustrated. In this embodiment, the first lamp 302 comprises a tubular fluorescent lamp and the second lamp 304 comprises a flat fluorescent lamp.

The tubular first lamp 302 again includes a glass tube 310 having a phosphor coating 312 on the entire inside surface except in a first narrow region that forms an exit aperture 316 and a second narrow region that forms a first coupling aperture 314. In this illustrated embodiment, the tubular first lamp also includes a reflective coating 320 added between the hollow glass tube 310 and the phosphor coating 312. Again, this reflective coating 320 covers the interior of the glass tube 310 except in the first narrow region that forms exit aperture 316 and the narrow region that forms the first coupling aperture 314.

The flat lamp 304 is formed from a substrate 330, a portion of which is illustrated in FIG. 4. Substrate 330 is formed of any suitable material that is preferably rigid and self supporting, such as glass or ceramic. A channel 332 is formed in the substrate 330. The channel 332 defines the shape of the lamp itself. A transparent cover 334 is suitably attached to the substrate 330 such that the cover 334 and the channel 332 form an enclosure within the lamp 304. The transparent cover 334 is preferably formed of material having a coefficient of thermal expansion that matches substrate 330.

At least a portion of the enclosure interior (e.g., channel 332) is coated with a material that fluoresces in the visible spectrum when bombarded with ultraviolet radiation, typically phosphors. Additionally, plasma or other ultraviolet emissive material such as mercury and argon is placed in the enclosure. Finally, two cathodes 350 are formed at the ends of the channel. Typically, filaments would be included in the cathodes 350 for exiting the plasma or other ultraviolet emissive material.

The tubular first lamp 302 and flat second lamp 304 are bonded together with a bonding agent 340, with the bonding agent 340 preferably being reflective to improve light transmission between the second lamp 304 and the first lamp 302.

Like the first and second embodiments, the lamp system 300 facilitates improved reliability by providing the second lamp 304 proximate the first lamp 302 and coupled to the first lamp 302 though the coupling apertures 314. If and when the first lamp 302 fails, the second lamp 304 can be used to provide illumination. Specifically, light from the second lamp 304 passes through the coupling aperture 314 to the first lamp 302, where it can exit the first lamp 302 through the exit aperture 316 and illuminate the display. Thus, the first lamp 302 and second lamp 304 provides redundancy, with this redundancy used to improve the reliability of the display system.

In general, lamp driver systems are used to power lamps used in display systems. To filly provide lamp redundancy, it will be desirable in many applications to provide a lamp driver system that has the ability to switch between lamps. Such a system can determine when a failure has occurred in a lamp in the display and selectively drive the other lamp as a replacement. An example of such a lamp driver system is found in co-pending patent application "Lamp Driver System with Improved Redundancy", Ser. No. 10/699,388, filed on Oct. 31, 2003 and assigned to Honeywell International Inc.

It should also be noted that the lamp driver could be alternatively configured to drive both lamps simultaneously. For example, the lamp driver could be configured to drive the lamps with half the power going to each lamp. If one lamp is then lost, the lamp drive could adjust the power going to the remaining lamp to compensate for the loss in brightness. This method would have the possible advantage of extending the lifetime of the lamps due to the decreased power supplied to each lamp during normal operation.

The present invention thus provides an aperture lamp system that facilitates improved reliability and performance in a display system. The aperture lamp system provides improved reliability by providing a second lamp coupled to a first lamp though a coupling aperture. When the first lamp fails, the second lamp can be used to provide illumination to the display. Specifically, light from the second lamp passes through the coupling aperture to the first lamp, where it can exit the first lamp and illuminate the display. Thus, by coupling the first and second lamps together through a coupling aperture, a lamp system is provided where either the first lamp or second lamp can be used to provide illumination for the display. Thus, the first and second lamps provide redundancy, with this redundancy used to improve the reliability of the display system.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

What is claimed is:

1. A lamp system comprising:

a first aperture lamp, the first lamp including a first pair of cathodes, an exit aperture and a first coupling aperture; and a second aperture lamp, the second lamp including a second pair of cathodes, a second coupling aperture proximate the first coupling aperture such that light from the second lamp can pass to the first lamp through the first coupling aperture and the second coupling aperture.

2. The lamp system of claim 1 wherein the first lamp and the second lamp comprise tubular fluorescent lamps.

3. The lamp system of claim 1 wherein the first lamp further comprises a reflective coating formed on an inside surface of the first lamp.

4. The lamp system of claim 1 wherein the second lamp further comprises a reflective coating formed on an inside surface of the second lamp.

5. The lamp system of claim 1 wherein the first lamp is coupled to the second lamp with a bonding agent.

6. The lamp system of claim 5 wherein the bonding agent comprises a reflective bonding agent.

7. The lamp system of claim 1 wherein the second lamp comprises a flat lamp.

8. The lamp system of claim 1 wherein the first lamp comprises a flat lamp.

9. The lamp system of claim 1 wherein the exit aperture is coupled to a display for providing light to the display.

10. The lamp system of claim 1 wherein the first lamp comprises a phosphor coating on an interior surface of the first lamps and wherein the exit aperture and the first coupling aperture comprise a portion of the interior surfaced where the phosphor coating is not present.

11. A lamp system comprising:

a tubular first lamp, the first tubular lamp including a first reflective coating on a first surface of the first tubular lamp, a first pair of cathodes, an exit aperture and a first coupling aperture, wherein the exit aperture and the first coupling aperture comprise a portion of the first surface where the first reflective coating is not present, the exit aperture coupled to a display for providing light to the display; and a tubular second lamp, the tubular second lamp including a second reflective coating on a second surface of the second tubular lamp, a second pair of cathodes, a second coupling aperture proximate the first coupling aperture such that light from the second lamp can pass to the first lamp through the first coupling aperture and the second coupling aperture, wherein the second coupling aperture comprises a portion of the second surface where the second reflective coating is not present.

12. The lamp system of claim 11 wherein the first lamp further comprises a first phosphor coating formed on the first reflective coating and further comprises a second phosphor coating formed on the second reflective coating.

13. The lamp system of claim 12 wherein the first phosphor coating is not present where the first reflective coating is not present and wherein the second phosphor coating is not present where the second reflective coating is not present.

14. The lamp system of claim 11 wherein the first lamp is coupled to the second lamp with a reflective bonding agent.

15. The lamp system of claim 11 wherein the display comprises a liquid crystal display.

16. The lamp system of claim 11 wherein the first reflective coating on a first surface of the first tubular lamp comprises a first phosphor coating on a first interior surface of the first tubular lamp and wherein the exit aperture and the first coupling aperture comprise a portion of the first interior surface where the phosphor coating is not present, and wherein the second reflective coating on a second surface of the second tubular lamp comprises a phosphor coating on a second interior surface of the second tubular lamp and wherein the second coupling aperture comprises a portion of the second interior surface where the phosphor coating is not present.

17. A lamp system comprising:

a tubular first lamp, the first tubular lamp including a first reflective coating on a first surface of the first tubular lamp, a first pair of cathodes, an exit aperture and a first coupling aperture, wherein the exit aperture and the first coupling aperture comprise a portion of the first surface where the first reflective coating is not present, the exit aperture coupled to a display for providing light to the display; and a second lamp proximate the first lamp, the second lamp comprising:

a substrate, the substrate including a channel;

a second pair of cathodes at the channel, the channel and the second pair of cathodes defining the second lamp; and a cover, the cover providing a second coupling aperture such that light from the second lamp can pass to the first lamp through the first coupling aperture and the second coupling aperture.

18. The lamp system of claim 17 wherein the first lamp further comprises a first phosphor coating formed on the first reflective coating.

19. The lamp system of claim 17 wherein the first lamp is coupled to the second lamp with a reflective bonding agent.

20. The lamp system of claim 17 wherein the display comprises a liquid crystal display.

* * * * *

UNITED STATES PATENT AND TRADEMARK OFFICE

CERTIFICATE OF CORRECTION

PATENT NO. : 6,971,766 B2
APPLICATION NO. : 10/698773
DATED : December 6, 2005
INVENTOR(S) : Brian D. Cull It is certified that error appears in the above-identified patent and that said Letters Patent is hereby corrected as shown below:

Column 7, line 19, following “first”, delete “lamps” and insert --lamp,--

Signed and Sealed this

Twentieth Day of March, 2007

JON W. DUDAS
*Director of the United States Patent and Trademark Office*